US010026283B1

(12) United States Patent
Liu et al.

(10) Patent No.: US 10,026,283 B1
(45) Date of Patent: Jul. 17, 2018

(54) MULTI-SENSOR INTRUSION DETECTION SYSTEM

(71) Applicant: INTERNATIONAL BUSINESS MACHINES CORPORATION, Armonk, NY (US)

(72) Inventors: Chih-Hsiung Liu, Taipei (TW); Shaw-Ben Shi, Austin, TX (US); Yu Chen Zhou, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/627,896

(22) Filed: Jun. 20, 2017

(51) Int. Cl.

| | |
|---|---|
| ***G08B 13/00*** | (2006.01) |
| ***G08B 13/196*** | (2006.01) |
| ***G08B 13/16*** | (2006.01) |
| ***G08B 25/00*** | (2006.01) |
| ***G08B 25/14*** | (2006.01) |
| ***G08B 25/10*** | (2006.01) |

(52) U.S. Cl.
CPC ... *G08B 13/19602* (2013.01); *G08B 13/1672* (2013.01); *G08B 25/008* (2013.01); *G08B 25/009* (2013.01); *G08B 25/10* (2013.01); *G08B 25/14* (2013.01)

(58) Field of Classification Search
CPC ..... G06F 21/32; Y10S 901/01; B25J 9/0003; G06K 9/00885; G08B 13/00; G08B 13/2491; G08B 15/00; G08B 25/009; G08B 13/19602; G08B 13/1672; G08B 25/008; G08B 25/10; G08B 25/14
See application file for complete search history.

(56) References Cited

U.S. PATENT DOCUMENTS

| | | | |
|---|---|---|---|
| 7,158,776 | B1 | 1/2007 | Estes et al. |
| 7,417,378 | B2 | 8/2008 | Kim |
| 8,266,438 | B2 | 9/2012 | Orsini et al. |

(Continued)

OTHER PUBLICATIONS

BioID, "BioIDGraph_FaceVoicegraph", https://www.bioid.com/Content/images/about-technology-designer2.png, Printed on Jun. 9, 2017, 1 Page.

(Continued)

*Primary Examiner* — Brian Zimmerman
*Assistant Examiner* — Kevin Lau
(74) *Attorney, Agent, or Firm* — Anthony M. Pallone

(57) ABSTRACT

An embodiment of the present invention may include a system and method for intrusion detection of an unauthorized human. The embodiment may include a security device with a human presence detector, recognition mechanisms, and a computer coupled to the device over a network. The device may detect a human and notify the computer. In response, the computer may cause the device to collect and transmit recognition mechanism information. This may include causing the device to collect and transmit first information, determining a degree of match to each corresponding stored information associated with a human, and determining that a sufficient match does not exist. For each subsequent mechanism, the embodiment may include causing the device to collect and transmit the subsequent information, determining a degree of match, and in response to determining that the confidence level of the match is above the threshold, classifying the human as authorized.

12 Claims, 6 Drawing Sheets

(56) References Cited

U.S. PATENT DOCUMENTS

| | | | | |
|---|---|---|---|---|
| 9,208,676 | B2 | 12/2015 | Fadell et al. | |
| 9,494,936 | B2 | 11/2016 | Kerzner | |
| 2005/0237189 | A1* | 10/2005 | Tani | G05D 1/0246 340/541 |
| 2007/0241861 | A1* | 10/2007 | Venkatanna | G06F 21/32 340/5.52 |
| 2014/0218195 | A1 | 8/2014 | Buckley | |
| 2016/0116343 | A1 | 4/2016 | Dixon et al. | |
| 2016/0266577 | A1* | 9/2016 | Kerzner | G05D 1/0022 |

OTHER PUBLICATIONS

Ramesh, et al., "Method for Improved Two Factor Authentication using Text Password and Biometric Technology (Finger Print) for Computer Based System like ATM, Access Doors, Workstations, etc.", https://priorart.ip.com/IPCOM/000166329, Jan. 10, 2008, 3 pages.

Knightscope, "K5 Features", http://www.knightscope.com/, Copyright 2017, Printed on Jun. 2, 2017, 8 Pages.

Mell et al., "The NIST Definition of Cloud Computing", NIST, Sep. 2011, 7 Pages, Special Publication 800-145, U.S. Department of Commerce, Gaithersburg, MD.

* cited by examiner

MULTI-SENSOR INTRUSION DETECTION SYSTEM

BACKGROUND

The present invention relates to premises security, and more specifically, to intrusion detection of an unauthorized human.

BRIEF SUMMARY

An embodiment of the present invention may include a system and method for intrusion detection of an unauthorized human. The embodiment may include a security device with a human presence detector operated to detect the presence of a human, a plurality of recognition mechanisms that include a camera, a microphone, a keypad, a biometric sensor, and a computer operatively coupled to the security device over a network. The security device may be operated to detect the presence of a human, and to transmit a notification to the computer that a human has been detected. In response to receiving the notification, the computer operated to cause the security device to collect, and transmit to the computer, recognition mechanism information. Collection and transmission of recognition mechanism information may include causing the security device to collect and transmit to the computer, first recognition mechanism information from a first of the plurality of recognition mechanisms, determining a degree of match between the transmitted first recognition mechanism information and each of one or more corresponding stored recognition mechanism information associated with a human, and determining that the transmitted first recognition mechanism information does not match, to a degree above a threshold value, any of one or more corresponding stored recognition mechanism information. For each of one or more subsequent recognition mechanisms, based on a predefined order of the recognition mechanisms and until a determined recognition confidence level is above a corresponding threshold value, the embodiment may include causing the security device to collect and transmit to the computer, the subsequent recognition mechanism information from the subsequent recognition mechanism, determining a degree of match between the transmitted subsequent recognition mechanism information and corresponding stored recognition mechanism information, and in response to determining that the recognition confidence level is above the corresponding threshold value, classifying the corresponding human as authorized.

DETAILED DESCRIPTION

Figure 1:
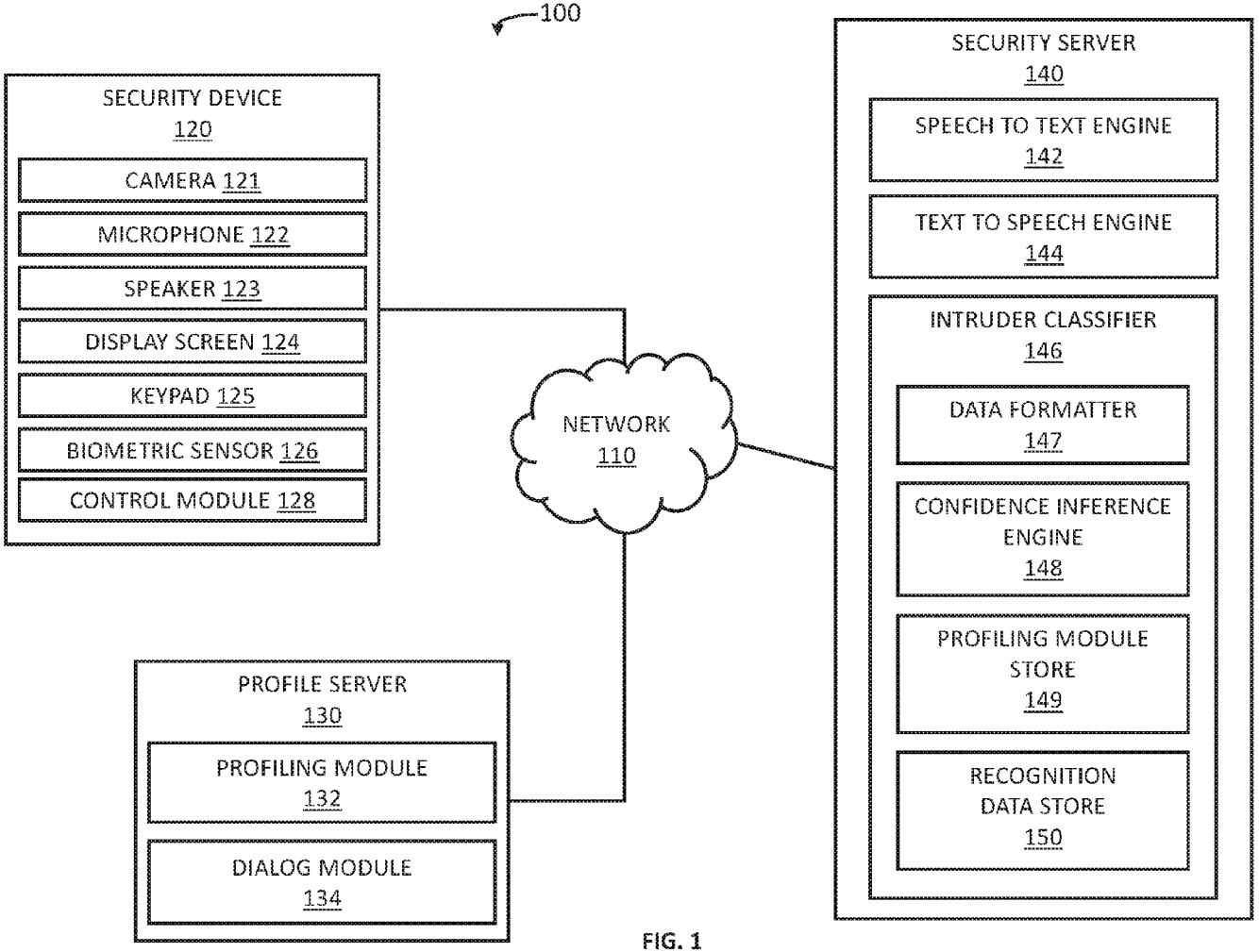
FIG. 1 is a functional block diagram illustrating an intrusion detection system, in accordance with an embodiment of the present invention.

Whether it is in the context of commercial property, for example a warehouse or shopping mall, or in the context of private property, such as a residence or university, implementing and maintaining the security of a premises can be of great concern. A lack of security may not only raise safety issues, but may also threaten to decrease property value. Technology has advanced to the point where non-human implemented security measures are increasingly playing a role in maintaining premises security, for example, video cameras utilizing facial recognition software. However, the use of facial recognition alone suffers from challenges in accuracy of user identification as various factors (e.g. lighting, camera angle and position) may prevent the sole use of facial recognition from being a reliable source of identification. Other devices, for example, a smart doorbell or a security robot, may utilize facial recognition in addition to voice recognition to secure access to some premises. However, even if additional recognition mechanisms are implemented, prompting a user to undertake all identification mechanisms every time might be burdensome for the user.

It would be advantageous to implement a device for premises security which utilizes a plurality of recognition mechanisms, in addition to facial recognition and voice recognition, yet remains selective on which and how many recognition mechanisms to engage when identifying an encountered human. Such a device may increase identification accuracy without unnecessarily burdening the user.

Embodiments of the present invention are directed to providing an intrusion detection system which leverages multiple recognition mechanisms for sensing and identification of a detected human, while limiting the number of recognition mechanisms the encountered human must undertake before being labeled as authorized, or as an intruder. In various embodiments, the intrusion detection system undergoes a training period during which it acquires data, through recognition mechanisms, identifying persons authorized for a premises. From the data acquired during training, the system generates mechanism specific recognition models for each authorized person and a recognition mechanism decision tree which specifies the order of recognition mechanism implementation to be used during post-training normal operation. During normal operation, the intrusion detection system challenges an encountered human with recognition mechanisms in accordance with the recognition mechanism decision tree. As the encountered human undergoes a recognition mechanism challenge, the system determines a confidence level for the mechanism specific response and compares it to an associated threshold value. If the determined confidence level exceeds the threshold value, the intrusion detection system labels the encountered human as authorized. The system proceeds to the next recognition mechanism in the recognition mechanism decision tree if the determined confidence level is below the threshold value. The determined confidence level, and the threshold value, may be determined by the level of the recognition mechanism decision tree and the previous recognition mechanism challenge results. Once the determined confidence value exceeds the threshold value, the system ceases to traverse the recognition mechanism decision tree and labels the encountered human as authorized. However, if the recognition mechanism decision tree is fully traversed and the determined confidence level fails to exceed the threshold value, the system labels the encountered human as an intruder.

FIG. 1 is a functional block diagram illustrating intrusion detection system 100, in accordance with an embodiment of the present invention. Intrusion detection system 100 may be a distributed communication environment, including security device 120, profile server 130, and security server 140, all interconnected via network 110.

In an exemplary embodiment, network 110 may be implemented as, for example, a local area network (LAN), a wide area network (WAN) such as the Internet, or a combination of the two. Network 110 may include, for example, wired, wireless or fiber optic connections. In general, network 110 may be any combination of connections and protocols that will support communications between security device 120, profile server 130, and security server 140, in accordance with an embodiment of the invention.

In exemplary embodiment, each of profile server 130 and security server 140 may be a laptop computer, desktop computer, computer server, blade server, or any other type of computing platform, computer system, programmable electronic device, or information system known in the art, in accordance with embodiments of the present invention, and may each include internal and external hardware components, as depicted in further detail below with reference to FIG. 4. In other embodiments, profile server 130 and/or security server 140 may be implemented in a cloud computing environment, as described in relation to FIGS. 5 and 6, below.

Security device 120 represents a platform for detecting the presence of a person, and determining, based on various recognition mechanisms and challenges to the person, if the person is authorized to, for example, pass a threshold, or is an intruder. In an exemplary embodiment, security device 120 may be an integrated wall-mounted module at the threshold of a secure location. For example, security device 120 may be implemented as an authentication device at the door to a secure room or facility, or a "smart" doorbell at the entrance to a home. Once a detected person is classified as authorized, security device 120 may allow physical entrance to the secure room, facility, or home by unlocking or releasing some locking mechanism. In an exemplary embodiment, security device 120 may include a plurality of sensors, input devices, and output devices. For example, security monitor 120 may include camera 121, microphone 122, speaker 123, display screen 124, keypad 125, and biometric sensor 126. Security device 120 may also include control module 128.

Camera 121 represents a device that can form a facial image that can then be used in a facial recognition system. In an exemplary embodiment, camera 121 may include, for example, an outdoor or indoor digital camera capable of capturing facial images and human shapes. In other embodiments, camera 121 may be include, for example, an IR camera, a sonic imaging system, a laser imaging system, or a radar. In various embodiments, the captured digital images can correspond to, for example, a video stream, a series of images captured at regular intervals, or images captured as the result of a triggering event, such as detected motion of human shapes. Furthermore, a triggering event, such as detected motion, may cause camera 121 to transmit, via control module 128, any captured images to data formatter 147.

Microphone 122 represents a device that can form a digital voice pattern that can then be used in a voice recognition system. In an exemplary embodiment, microphone 122 may include a device capable of detecting acoustic signals, such as, for example, a piezoelectric transducer, which may allow microphone 122 to receive and sample acoustic signals in the form of a human's voice.

In an exemplary embodiment, speaker 123 may represent a device capable of outputting an acoustic signal, such as, for example, a digital voice signal or text-to-speech data. Speaker 123 may receive the acoustic signal, via control module 128, from a computing platform, such as profile server 130 or security server 140. In various embodiments, speaker 123 may output verbal instructions to a detected human.

In an exemplary embodiment, display screen 124 may represent a device capable of displaying text or images. Display screen 124 may receive text or images to display, via control module 128, from a computing platform, such as profile server 130 or security server 140. In various embodiments, display screen may provide visual instructions to a detected human. In various other embodiments, display screen 124 may be implemented as a touch screen device.

In an exemplary embodiment, keypad 125 may represent a device capable of receiving alphanumeric input. Keypad 125 may include, for example, a fixed keyboard or keypad, a removable keyboard or keypad, or a virtual keyboard displayed on display screen 124.

Biometric sensor 126 may represent one or more devices capable of receiving human biometric input and forming digital biometric patterns that can then be used in a biometric recognition system. In an exemplary embodiment, biometric sensor 126 may include, for example, a fingerprint scanner, a pupillometry scanner, and/or a retina scanner. In various other embodiments, biometric sensor 126 may include, for example, a heart rate monitor, a breathing rate monitor, or a DNA analyzer.

Control module 128 represents software and hardware operated to control the operation of the recognition mechanisms, and to transmit and receive data to and from the recognition mechanisms. In an exemplary embodiment, control module 128 may be a microprocessor programmed to control the recognition mechanism sensors (e.g. camera 121, microphone 122, keypad 125, biometric sensor 126), located on security device 120, to function in response to one or more commands from another computing platform, such as profile server 130 or security server 140, or in response to a triggering event, such as detected motion by camera 121. Control module 128 may also control transmission of data received by the recognition mechanisms, located on security device 120, over network 110 in a digital protocol to another computing platform, such as profile server 130 or security server 140.

In other embodiments, security device 120 may be implemented as a mobile platform which houses the plurality of recognition mechanism sensors. One such mobile platform may be in the form of a mobile robotic device, such as a humanoid robot, to which security device 120 may be attached or affixed. For example, cameras may be positioned in place of eyes, microphones may be positioned in place of ears, and a speaker may be positioned in place of a mouth. Additionally, the humanoid robot implementation of security device 120 may also have biometric sensors located on the arms and hands. The arms may also function to detain an identified intruder. In yet another embodiment, security device 120 may be implemented as a distributed system with recognition mechanisms positioned throughout some premises. In various embodiments, security device 120 may be depicted with reference to FIG. 4.

Profile server 130 represents a computing platform to host the functionality for training the intrusion detection system of FIG. 1. In an exemplary embodiment, profile server 130 may include profiling module 132 and dialog module 134. Profiling server 130 may send and receive data, over network 110, to and from other computing platforms such as security device 120, via control module 128, and security server 140.

In an exemplary embodiment, profiling module 132 gathers data identifying authorized persons. Profiling module 132 may be a program, or subroutine contained in a program, that may receive data from security device 120, while in a training period. During the training period, security device 120 may collect and transmit, via control module 128, information from camera 121, microphone 122, keypad 125, and/or biometric sensor 126 identifying humans authorized for a premises. Based on the data received during the training period, profiling module 132 may generate a recognition model for each authorized human, based on data received from a recognition mechanism (e.g. camera 121, microphone 122, keypad 125, biometric sensor 126). In various embodiments, recognition models may include a pattern of leaving or entering some premises (time pattern), the facial images of an authorized human (facial pattern), an authorized human's recorded speech pattern (voice pattern), fingerprints for an authorized human (biometric pattern), and the passcode for an authorized human (passcode). Furthermore, in various embodiments, each recognition model may have a determined accuracy level as well as a determined convenience level. The accuracy level may represent the effectiveness of the recognition mechanism while the convenience level may represent a recognition mechanism's ease of use for an encountered human. For example, the facial recognition mechanism has a higher convenience level than the voice recognition mechanism since voice recognition requires the encountered human to provide input (i.e. speech).

Additionally, in an exemplary embodiment, profiling module 132 may generate a recognition mechanism decision tree, according to known algorithms for tree generation, for utilization by intruder classifier 146 as described below. The recognition mechanism decision tree may specify the sequence for activation of different recognition mechanisms (e.g. camera 121, microphone 122, keypad 125, biometric sensor 126) to be used in identifying an encountered human. The recognition models and the recognition mechanism decision tree may be transmitted, over network 110, from profiling server 130 to security server 140 for storage in profiling module store 149. In an embodiment, the recognition mechanism decision tree generated by profiling module 134, may specify an optimal sequence for activation of different recognition mechanisms, located on security device 120, to be used in identifying a human from a group of authorized humans. The optimization of the tree may be based on the data received during the training period. For example, if data received during the training period identifying authorized family members indicates that facial patterns among the family members have little variance, while voice patterns among the family members have more variance, then the recognition mechanism decision tree would order activation of microphone 122 for voice pattern analysis before activation of camera 121 for facial pattern analysis. In another embodiment, the sequence for activation of different recognition mechanisms within the recognition mechanism decision tree may be sorted, in descending order, by the product of recognition mechanism accuracy multiplied by recognition mechanism convenience. The recognition mechanism with the largest resulting product will be activated first. In yet another embodiment, the recognition mechanism decision tree, and therefore the sequence of recognition mechanism activation, may be determined by an intrusion detection system administrator.

Dialog module 134 enables conversation between the intrusion detection system and an encountered person. In an exemplary embodiment, dialog module 134 may be a program, or subroutine contained in a program, that may conduct conversation with, and prompt input from, an encountered human through utilization of speech-to-text engine 142 and text-to-speech engine 144, described in more detail below, and microphone 122, speaker 123, and/or keypad 125. In an exemplary embodiment, authorized humans may, during a training period, provide dialog module 134 with predetermined questions and answers either by speaking into microphone 122 or entering text into keypad 125. Dialog module 134 may then be instructed, during post training operation, to ask an encountered human one or more questions. Although FIG. 1 depicts dialog module 134 as located within profile server 130, in various other embodiments, dialog module 134 may be located within security server 140, within security device 120, or within some other platform.

Security server 140 represents a computing platform to host the functionality for performing the intrusion detection system of FIG. 1. In an exemplary embodiment, security server 140 may include speech-to-text (STT) engine 142, text-to-speech (TTS) engine 144, and intruder classifier 146. Security server 140 represents a computing platform capable of hosting STT engine 142, TTS engine 144, and intruder classifier 146. Security server 140 sends and receives data, over network 110, to and from other computing platforms such as security device 120, via control module 128, and profile server 130. Although not shown, optionally, security server 140 may include a cluster of servers executing the same software to collectively receive, process, and transmit data between other computing platforms such as security device 120 and profile server 130.

In an exemplary embodiment, STT engine 142 may be a program, or subroutine contained in a program, that may transcribe audio data (i.e. a human voice) into written words for a display, such as display screen 124, for transmission, or both. STT engine 142 allows for dialog module 134 to interact with an encountered human by enabling an encountered human to speak to security device 120, via microphone 122. For example, an encountered human may respond to a passcode prompt orally using microphone 122. Control module 128 may transmit the acoustic signal received by microphone 122 to STT engine 142, STT engine 142 may then transcribe the oral response into text for output. STT engine 142 can be any commercially available, open source, or proprietary speech-to-text program that implements the functionality of dialog module 134, in accordance with embodiments of the invention.

In an exemplary embodiment, TTS engine 144 may be a program, or subroutine contained in a program, that may transform text into an acoustic signal (e.g. a computer-generated voice) for output through a speaker on security device 120, such as speaker 123, via control module 128. TTS engine 144 allows for dialog module 134 to interact with an encountered human by enabling dialog module 134 to speak to the encountered human. For example, dialog module 134 may utilize TTS engine 144 to ask an encountered human a security question through speaker 123. TTS engine 144 can be any commercially available, open source, or proprietary text-to-speech program that implements the functionality of dialog module 134, in accordance with embodiments of the invention.

Intruder classifier 146 classifies an encountered human as an authorized person or as an intruder, based on comparison of data received in response to recognition mechanism challenges posed to the encountered human and corresponding recognition models. In an exemplary embodiment, intruder classifier 146 may be a program, or subroutine contained in a program, that may receive data, via control module 128, from one or more recognition mechanisms (e.g. camera 121, microphone 122, keypad 125, biometric sensor 126), located on security device 120. Intruder classifier 146 may analyze the received data, and classify a human encountered within a premises as authorized or as an intruder, based on a determined confidence level. Additionally, intruder classifier 146 may generate a script from the questions provided to dialog module 134 during a training period and instruct dialog module 134 to ask an encountered human one or more scripted questions. Intruder classifier 146 may include data formatter 147, confidence inference engine 148, profiling module store 149, and recognition data store 150.

In an exemplary embodiment, profiling module store 149 represents a database management system that may be used to store data received from profile server 130. Profiling module store 149 receives one or more recognition models for every recognition mechanism located on security device 120 and a recognition mechanism decision tree. In an example embodiment, profile module store 149 may store the received one or more recognition models and decision tree until use by confidence inference engine 148.

Data formatter 147 receives raw data, via control module 128, from recognition mechanisms located on security device 120 and formats the received raw data for later use. In an exemplary embodiment, data formatter 147 operates to transform recognition mechanism specific data, received by intruder classifier 146, from security device 120 via control module 128, into a format suitable for comparison by confidence inference engine 148. Data formatter 147 may then send the transformed recognition mechanism specific data to recognition data store 150 for storage until use by confidence inference engine 148.

In an exemplary embodiment, recognition data store 150 represents a database management system that may be used to store data received from data formatter 147. Recognition data store 150 receives, from data formatter 147, formatted recognition mechanism specific data. In an example embodiment, recognition data store 150 may store transformed recognition mechanism specific data, for one or more recognition mechanisms located on security device 120, until use by confidence inference engine 148.

Confidence inference engine 148 performs the classification capability of intruder classifier 146. In an exemplary embodiment confidence inference engine 148 may operate to compare received recognition mechanism specific data, accessed from recognition data store 150, to the corresponding individual recognition models, accessed from profiling module store 149. Based on comparison to the one or more mechanism specific recognition models, confidence inference engine 148 calculates a recognition confidence level for the received recognition mechanism specific data. In various other embodiments, confidence inference engine 148 may compare combinations of recognition mechanism specific data and calculate a recognition confidence level for the combination of mechanism specific data received. Furthermore, in an exemplary embodiment, confidence inference engine 148 may also activate, via control module 128, subsequent recognition mechanisms located on security device 120, according to the sequence defined in the recognition mechanism decision tree, accessed from profiling module store 149. With every comparison to a mechanism specific recognition model, confidence inference engine 148 calculates a recognition confidence level for the corresponding received recognition mechanism specific data and compares the calculated confidence level to a threshold value. As confidence inference engine 148 traverses the recognition mechanism decision tree in response to an encountered human, it may track and total any previously calculated recognition confidence levels and compare the overall recognition confidence level to the threshold value. Confidence inference engine 148 may label an encountered human as an intruder when it has fully traversed the recognition mechanism decision tree and the overall recognition confidence level has not exceeded the threshold value.

In various embodiments, the overall confidence may be calculated in accordance with the following formula:

$$OC(n) = \sum_{i=1}^{n} S_i(conf) \times \left( S_i(accu) \div \sum_{j=1}^{n} S_j(accu) \right) \tag{1}$$

where Si(conf) is the confidence score when applying a recognition mechanism to the encountered human, as determined from a training period, and Si(accu) is the accuracy level of the applied recognition mechanism. In an example, assuming the threshold value (T) is 0.75, facial recognition—S1(accu)=0.7, voice recognition—S2(accu)=0.8, and biometric recognition—S3(accu)=0.9, formula (1) may calculate as follows:

n=1

At beginning, we apply S1 only (n=1). Let's assume S1(conf)=0.6

$$OC(1)=S1(\text{conf})*(S1(\text{accu})/S1(\text{accu}))=0.6*(0.7/0.7)=0.6,$$

which is less than the threshold of 0.75, therefore, we add another recognition mechanism . . .

n=2

Let's assume S2(conf)=0.9, which means voice recognition works well $$OC(2)=S1(\text{conf})*(S1(\text{accu})/(S1(\text{accu})+S2(\text{accu}))+S2(\text{conf})*(S2(\text{accu})/(S1(\text{accu})+S2(\text{accu}))$$

$$=0.6*(0.7/(0.7+0.8))+0.9*(0.8/(0.7+0.8))=0.28+0.49=0.77$$

Since 0.77>0.75 (T), we have sufficient confidence that the encountered human is authorized and therefore there is no need to add an additional recognition mechanism.

In an example embodiment, confidence inference engine 148 may compare facial image data, collected from an encountered human and accessed from recognition data store 150, to an individual facial recognition model, accessed from profiling module store 149, and calculate a facial recognition confidence level based on the comparison. Confidence inference engine 148 may then determine that the facial confidence level does not exceed a threshold value and in response activate, vial control module 128, the next recognition mechanism, based on reference to the recognition mechanism decision tree stored in profiling module store 149. In an example embodiment, the next recognition mechanism activated may be microphone 122 so that digital voice data may be acquired and ultimately propagated, via control module 128 and data formatter 147, to recognition data store 150. Confidence inference engine 148 may then compare digital voice data, accessed from recognition data store 150, to an individual voice recognition model, accessed from profiling module store 149, and calculate a voice recognition confidence level based on the comparison. Confidence inference engine 148 may then determine that the overall confidence level (i.e. facial and voice confidence levels combined) exceeds the threshold value and label the encountered human as authorized. The choice of the methodologies behind the comparison and the calculation of the overall confidence level may be chosen as a matter of design, based, for example, on related industry best practices.

Figure 2:
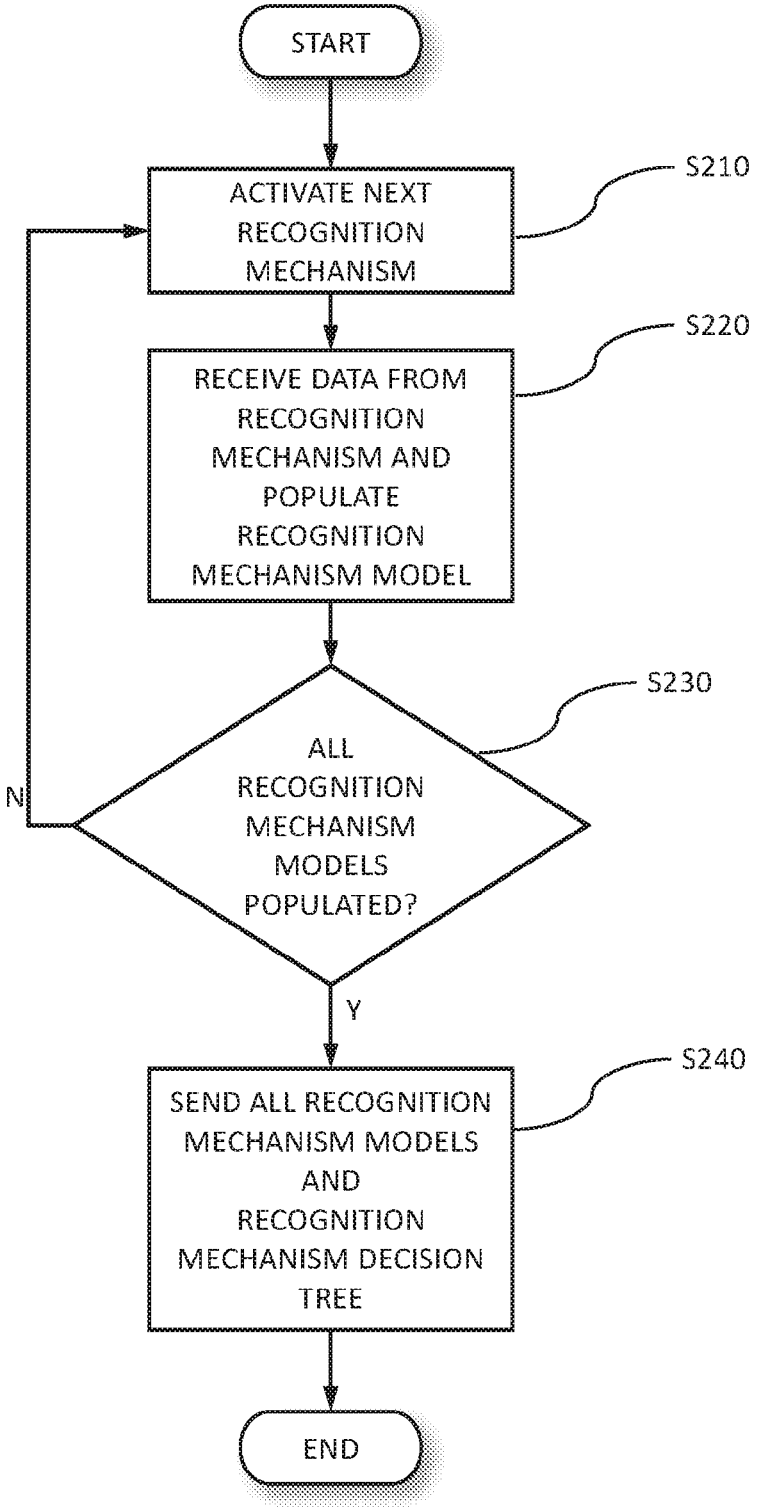
FIG. 2 is a flowchart illustrating the operations of the profiling module of FIG. 1, in accordance with an embodiment of the invention.

FIG. 2 is a flowchart depicting the operational steps of profiling module 132 in accordance with various embodiments of the invention. In an exemplary embodiment, during a training period, profiling module 132 may activate, through control module 128, a recognition mechanism (e.g. camera 121, microphone 122, keypad 125, biometric sensor 126) located on security device 120 (step S210). Profiling module 132 may receive, via control module 128, recognition mechanism specific data identifying a human authorized for some premises. Based on the received recognition mechanism specific data, profiling module 132 may then populate a recognition mechanism specific model for the human identified as authorized for some premises (step S220). Profiling module 132 may ensure that a recognition mechanism model has been populated for each recognition mechanism located on security device 120 (step S230). If not all recognition mechanism models have been populated (step S230, "N" branch), profiling module 132 may activate the next recognition mechanism (step S210) without a populated recognition model. Once a recognition mechanism model has been populated for all recognition mechanisms located on security device 120, profiling module 132 may transmit the models, via profile server 130, to profiling module store 149 (step S240).

Figure 3:
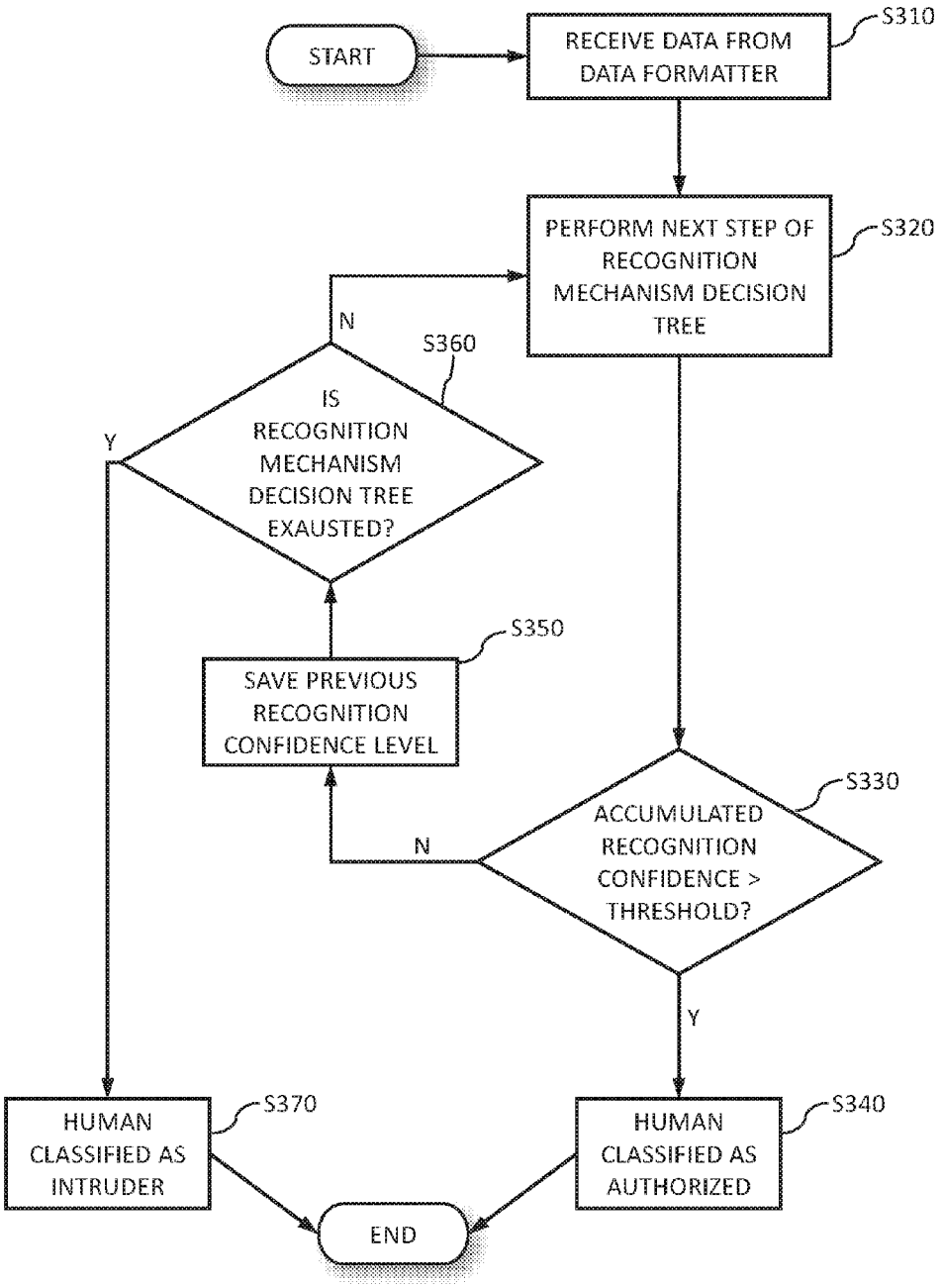
FIG. 3 is a flowchart illustrating the operations of the intruder classifier of FIG. 1, in accordance with an embodiment of the invention.

FIG. 3 is a flowchart depicting the operational steps of intruder classifier 146 in accordance with various embodiments of the invention. In an exemplary embodiment, intruder classifier 146 may receive data from data formatter 147 and initiate the process of classifying the encountered human as an intruder or as an authorized person (step S310). As an example, intruder classifier 146 may receive image data from data formatter 147 resulting from images taken by camera 121, in response to detected motion, and transmitted by control module 128 to data formatter 147. Confidence inference engine 148 may then refer to a recognition mechanism decision tree, which may be received from profiling module 132 and stored in confidence inference engine 148, to determine which recognition mechanism, within security device 120, to implement, via control module 128, as part of the classification process (step S320). As each recognition mechanism (e.g. camera 121, microphone 122, keypad 125, biometric sensor 126) is implemented, confidence inference engine 148 compares the recognition mechanism specific data, received by data formatter 147, against the recognition model, received from profiling module 132 and stored in confidence inference engine 148, for the specified recognition mechanism. For each comparison, confidence inference engine 148 calculates a recognition confidence level for the received recognition mechanism specific data (step S320). Confidence inference engine 148 may then total any calculated recognition confidence levels and determine whether the totaled/overall recognition confidence level is greater than a threshold value (step S330). If the accumulated recognition confidence level exceeds the threshold value (step S330, "Y" branch), confidence inference engine 148 labels the encountered human as an authorized person (step S340). However, if the accumulated recognition confidence level does not exceed the threshold value (step S330, "N" branch), confidence inference engine 148 saves the calculated recognition confidence level (step S350) and proceeds to determine if the recognition mechanism decision tree has been fully traversed (step S360). If the recognition mechanism decision tree has not been fully traversed (step S360, "N" branch), confidence inference engine 148 proceeds to implement the next step of the recognition mechanism decision tree (step S320). However, if the recognition mechanism decision tree has been fully traversed (step S360, "Y" branch), confidence inference engine 148 labels the encountered human as an intruder (step S370).

Figure 4:
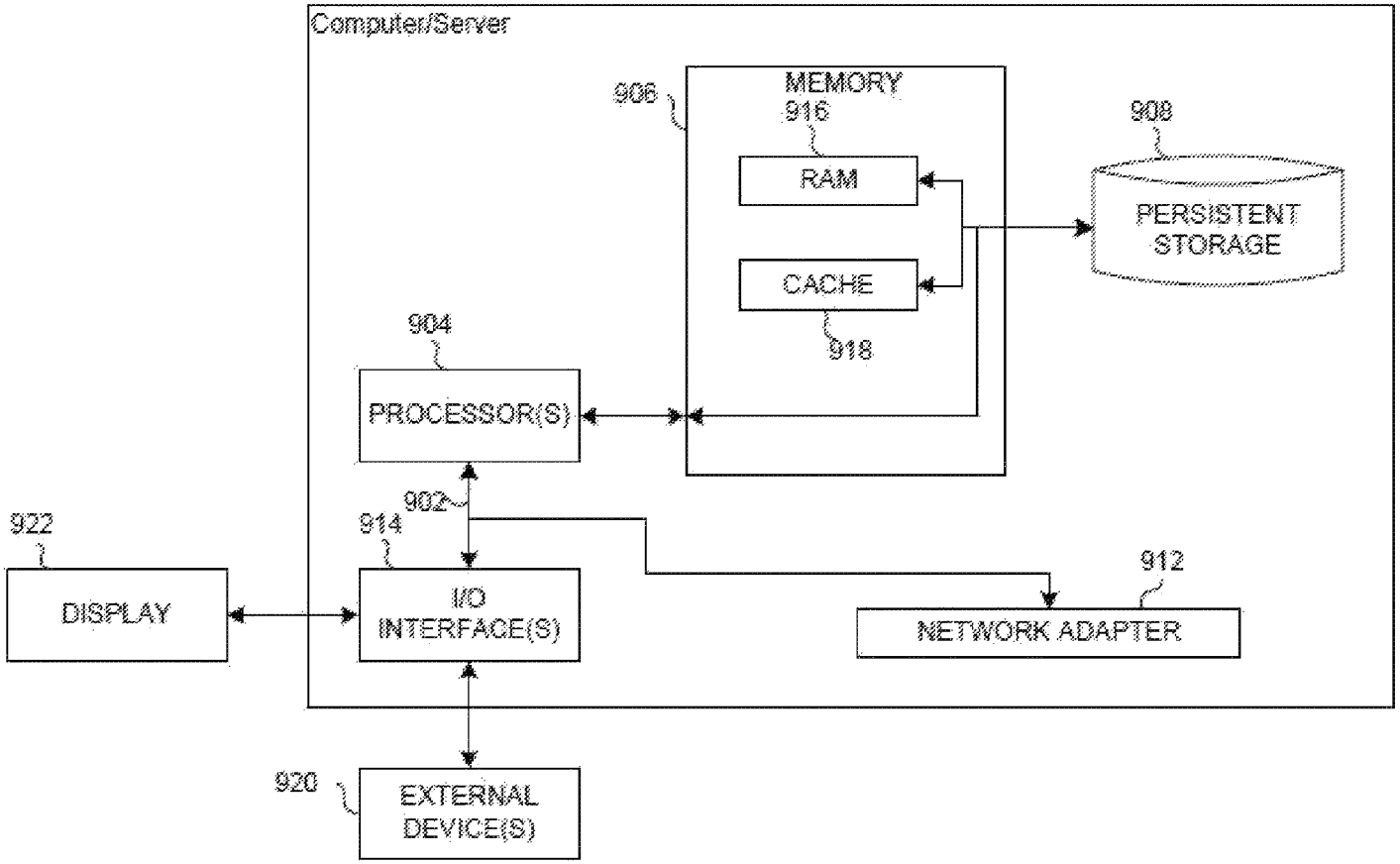
FIG. 4 is a block diagram depicting the hardware components of the intrusion system of FIG. 1, in accordance with an embodiment of the invention.

FIG. 4 depicts a block diagram of components of profile server 130 and security server 140, in accordance with an illustrative embodiment of the present invention. It should be appreciated that FIG. 4 provides only an illustration of one implementation and does not imply any limitations with regard to the environments in which different embodiments may be implemented. Many modifications to the depicted environment may be made.

Profile server 130 and security server 140 include communications fabric 902, which provides communications between computer processor(s) 904, memory 906, persistent storage 908, network adapter 912, and input/output (I/O) interface(s) 914. Communications fabric 902 can be implemented with any architecture designed for passing data and/or control information between processors (such as microprocessors, communications and network processors, etc.), system memory, peripheral devices, and any other hardware components within a system. For example, communications fabric 902 can be implemented with one or more buses.

Memory 906 and persistent storage 908 are computer-readable storage media. In this embodiment, memory 906 includes random access memory (RAM) 916 and cache memory 918. In general, memory 906 can include any suitable volatile or non-volatile computer-readable storage media.

The programs profiling module 132 and dialog module 134 in profile server 130; and STT engine 142, TTS engine 144, intruder classifier 146, data formatter 147, confidence inference engine 148, profiling module store 149, and recognition data store 150 in security server 140 are stored in persistent storage 908 for execution by one or more of the respective computer processors 904 via one or more memories of memory 906. In this embodiment, persistent storage 908 includes a magnetic hard disk drive. Alternatively, or in addition to a magnetic hard disk drive, persistent storage 908 can include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 908 may also be removable. For example, a removable hard drive may be used for persistent storage 908. Other examples include optical and magnetic disks, thumb drives, and smart cards that are inserted into a drive for transfer onto another computer-readable storage medium that is also part of persistent storage 908.

Network adapter 912, in these examples, provides for communications with other data processing systems or devices. In these examples, network adapter 912 includes one or more network interface cards. Network adapter 912 may provide communications through the use of either or both physical and wireless communications links. The programs profiling module 132 and dialog module 134 in profile server 130; and STT engine 142, TTS engine 144, intruder classifier 146, data formatter 147, confidence inference engine 148, profiling module store 149, and recognition data store 150 in security server 140 may be downloaded to persistent storage 908 through network adapter 912.

I/O interface(s) 914 allows for input and output of data with other devices that may be connected to network attached storage 120 and server 110. For example, I/O interface 914 may provide a connection to external devices 920 such as a keyboard, keypad, a touch screen, and/or some other suitable input device. External devices 920 can also include portable computer-readable storage media such as, for example, thumb drives, portable optical or magnetic disks, and memory cards. Software and data used to practice embodiments of the present invention, e.g., the programs profiling module 132 and dialog module 134 in profile server 130; and STT engine 142, TTS engine 144, intruder classifier 146, data formatter 147, confidence inference engine 148, profiling module store 149, and recognition data store 150 in security server 140, can be stored on such portable computer-readable storage media and can be loaded onto persistent storage 908 via I/O interface(s) 914. I/O interface(s) 914 can also connect to a display 922.

Display 922 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

While steps of the disclosed method and components of the disclosed systems and environments have been sequentially or serially identified using numbers and letters, such numbering or lettering is not an indication that such steps must be performed in the order recited, and is merely provided to facilitate clear referencing of the method's steps. Furthermore, steps of the method may be performed in parallel to perform their described functionality.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 5:
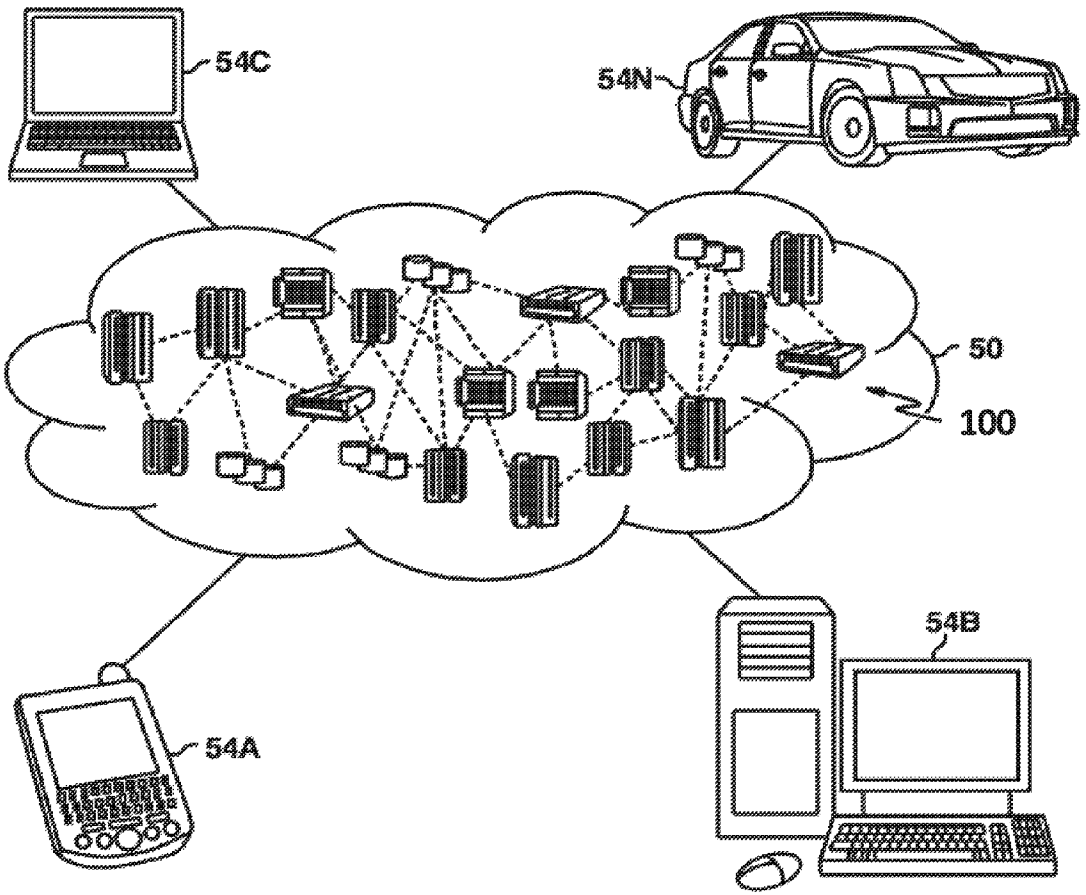
FIG. 5 depicts a cloud computing environment in accordance with an embodiment of the present invention.

Referring now to FIG. 5, illustrative cloud computing environment 50 is depicted. As shown, cloud computing environment 50 includes one or more cloud computing nodes 100 with which local computing devices used by cloud consumers, such as, for example, personal digital assistant (PDA) or cellular telephone 54A, desktop computer 54B, laptop computer 54C, and/or automobile computer system 54N may communicate. Nodes 100 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 5 are intended to be illustrative only and that computing nodes 100 and cloud computing environment 50 can communicate with any type of computerized device over any type of network and/or network addressable connection (e.g., using a web browser).

Figure 6:
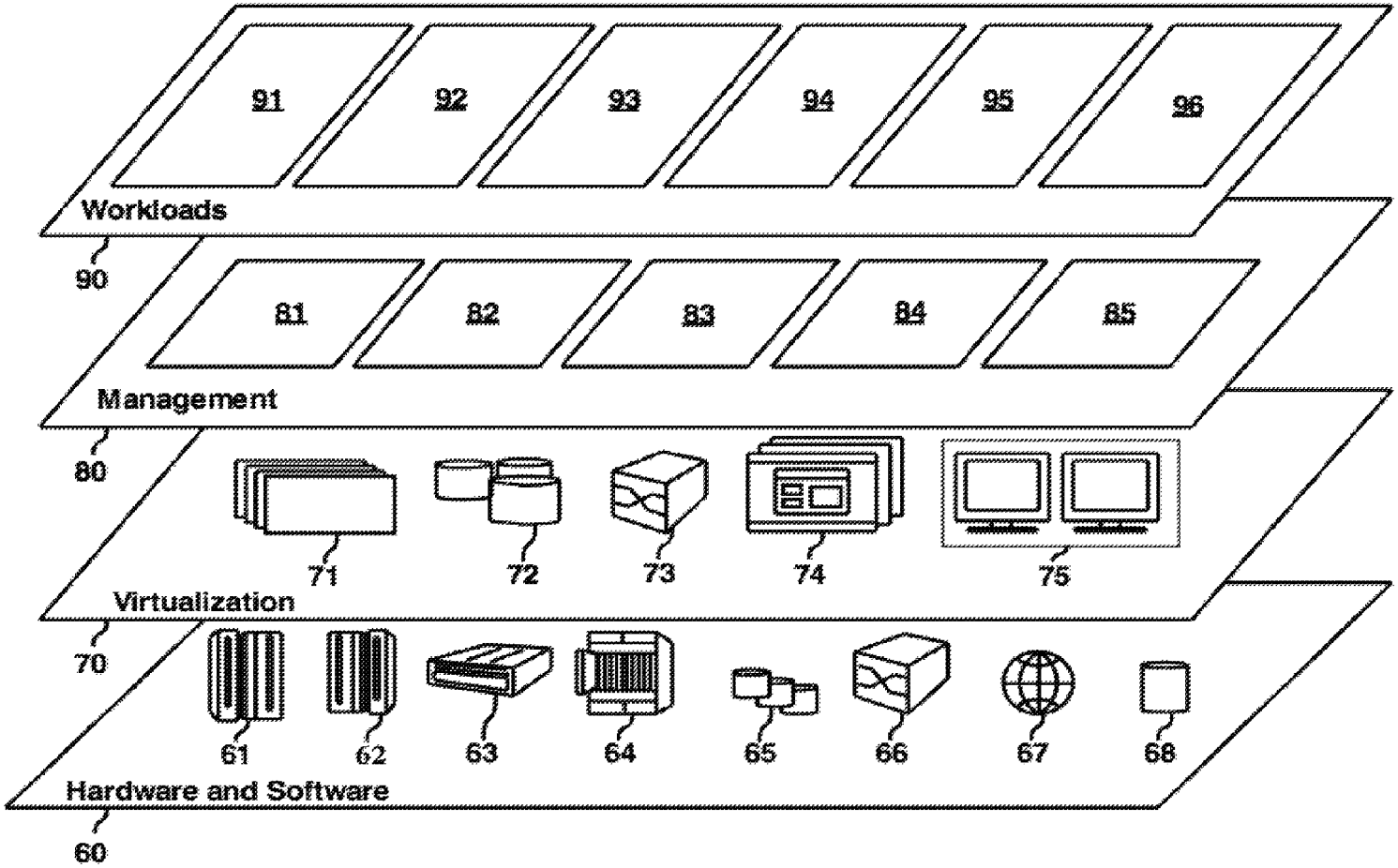
FIG. 6 depicts abstraction model layers in accordance with an embodiment of the present invention.

Referring now to FIG. 6, a set of functional abstraction layers provided by cloud computing environment 50 (FIG. 5) is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and intrusion detection system 96. Intrusion detection system 96 may relate to the detection of an intruder within some premises.

The descriptions of the various embodiments of the present invention have been presented for purposes of illustration, but are not intended to be exhaustive or limited to the embodiments disclosed. The terminology used herein was chosen to explain the principles of the one or more embodiments, the practical application or technical improvement over technologies found in the marketplace, or to enable others of ordinary skill in the art to understand the embodiments. Various modifications, additions, substitutions, and the like will be apparent to those of ordinary skill in the art without departing from the scope and spirit of the invention, as defined in the following claims.

What is claimed is:

1. A system for identifying an intruder, the system comprising:

a security device comprising: a human presence detector operated to detect the presence of a human, a plurality of recognition mechanisms that include a camera, a microphone, a keypad, and a biometric sensor; and a computer operatively coupled to the security device over a network;

the security device operated to detect the presence of a human, and to transmit a notification to the computer that a human has been detected;

in response to receiving the notification, the computer operated to cause the security device to collect, and transmit to the computer, recognition mechanism information in accordance to the following:

causing, by the computer, the security device to collect and transmit to the computer, first recognition mechanism information from a first of the plurality of recognition mechanisms;

determining, by the computer, a degree of the match between the transmitted first recognition mechanism information and each of one or more corresponding stored recognition mechanism information, wherein each stored recognition mechanism information is associated with a human;

determining, by the computer, that the transmitted first recognition mechanism information does not match, to a degree above a threshold value, any of the one or more corresponding stored recognition mechanism information;

for each of one or more subsequent recognition mechanisms, wherein a sequence for activation of the one or more subsequent recognition mechanisms is sorted, in descending order, by a product of a recognition mechanism accuracy multiplied by a recognition mechanism convenience, until a determined recognition confidence level is above a corresponding threshold value:

causing, by the computer, the security device to collect and transmit to the computer, the subsequent recognition mechanism information from the subsequent recognition mechanism;

determining, by the computer, a degree of the match between the transmitted subsequent recognition mechanism information and corresponding stored recognition mechanism information; and in response to determining that the recognition confidence level is above the corresponding threshold value, classifying the corresponding human as authorized.

2. The system of claim 1, further comprising:

in response to determining, by the computer, that the security device has collected and transmitted to the computer, the subsequent recognition mechanism information from all subsequent recognition mechanism and the recognition confidence level is not above the corresponding threshold value, classifying the corresponding human as an intruder.

3. The system of claim 1, wherein the determined recognition confidence level is a function of the degree of the match between the transmitted subsequent recognition mechanism information and each of one or more corresponding stored recognition mechanism information, and the corresponding threshold value is based on the subsequent recognition mechanism.

4. The system of claim 1, wherein the security device further includes a speaker, a display screen, and wherein causing, by the computer, the security device to collect, and transmit to the computer, recognition mechanism information further comprises an element from the group consisting of:

providing verbal instructions to the detected human, and providing visual instructions to the detected human.

5. The system of claim 1, wherein the security device is positioned at a threshold of a premises.

6. The system of claim 1, wherein the security device is affixed to a mobile robotic device.

7. The system of claim 1, wherein each of the one or more corresponding stored recognition mechanism information is associated with one or more humans classified as authorized during a training period.

8. A method for identifying an intruder, the method comprising:

detecting, by a human presence detector of a security device, the presence of a human;

transmitting, by the security device over a network to a computer, a notification that a human has been detected;

in response to receiving the notification, the computer directing the security device to collect, and transmit to the computer, recognition mechanism information in accordance to the following:

causing, by the computer, the security device to collect and transmit to the computer, first recognition mechanism information from a first of a plurality of recognition mechanisms, wherein the plurality of recognition mechanisms includes a camera, a microphone, a keypad, and a biometric sensor;

determining, by the computer, a degree of the match between the transmitted first recognition mechanism information and each of one or more corresponding stored recognition mechanism information, wherein each stored recognition mechanism information is associated with a human;

determining, by the computer, that the transmitted first recognition mechanism information does not match, to a degree above a threshold value, any of the one or more corresponding stored recognition mechanism information;

for each of one or more subsequent recognition mechanisms, wherein a sequence for activation of the one or more subsequent recognition mechanisms is sorted, in descending order, by a product of a recognition mechanism accuracy multiplied by a recognition mechanism convenience, until a determined recognition confidence level is above a corresponding threshold value;

causing, by the computer, the security device to collect and transmit to the computer, the subsequent recognition mechanism information from the subsequent recognition mechanism;

determining, by the computer, a degree of the match between the transmitted subsequent recognition mechanism information and corresponding stored recognition mechanism information; and in response to determining that the recognition confidence level is above the corresponding threshold value, classifying the corresponding human as authorized.

9. The method of claim 8, further comprising:

in response to determining that the security device has collected and transmitted to the computer, the subsequent recognition mechanism information from all subsequent recognition mechanism and the recognition confidence level is not above the corresponding threshold value, classifying the corresponding human as an intruder.

10. The method of claim 8, wherein the determined recognition confidence level is a function of the degree of the match between the transmitted subsequent recognition mechanism information and each of one or more corresponding stored recognition mechanism information, and the corresponding threshold value is based on the subsequent recognition mechanism.

11. The method of claim 8, wherein the security device further includes a speaker, a display screen, and wherein causing, by the computer, the security device to collect, and transmit to the computer, recognition mechanism information further comprises an element from the group consisting of:

providing verbal instructions to the detected human, and providing visual instructions to the detected human.

12. The method of claim 8, wherein each of the one or more corresponding stored recognition mechanism information is associated with one or more humans classified as authorized during a training period.

* * * * *